US006622897B2

(12) United States Patent
Bokmiller et al.

(10) Patent No.: US 6,622,897 B2
(45) **Date of Patent: *Sep. 23, 2003**

(54) PINCH-GRIP HANGER

(75) Inventors: David Bokmiller, Hudson, OH (US); Andrew M. Zuckerman, New York, NY (US)

(73) Assignee: A&E Products Group LP, Secauscus, NJ (US)

( * ) Notice: Subject to any disclaimer, the term of this patent is extended or adjusted under 35 U.S.C. 154(b) by 30 days.

This patent is subject to a terminal disclaimer.

(21) Appl. No.: 10/128,854

(22) Filed: Apr. 23, 2002

(65) Prior Publication Data

US 2003/0146252 A1 Aug. 7, 2003

Related U.S. Application Data

(63) Continuation-in-part of application No. 10/066,890, filed on Feb. 4, 2002.

(51) Int. Cl.[7] ..... A41D 27/22
(52) U.S. Cl. ..... 223/93; 223/85; 223/96
(58) Field of Search ..... 223/85, 93, 96

(56) References Cited

U.S. PATENT DOCUMENTS 5,082,153 A * 1/1992 Duester et al. ..... 223/96

* cited by examiner

*Primary Examiner*—John J. Calvert
*Assistant Examiner*—James G. Smith
(74) *Attorney, Agent, or Firm*—Amster, Rothstein & Ebenstein

(57) ABSTRACT

A hanger has a pinch-grip including a pair of vertically-extending components, a biasing spring, and a connector separate and distinct from the biasing spring. The connector pivotably secures together the upper ends of the components for movement, prior to application of the biasing spring to the components, between a substantially unfolded orientation, wherein the components lie in a common plane, and a substantially folded orientation, wherein the components are generally parallel. The connector is integrally molded with the components and configured and dimensioned to lie between the upper ends thereof when the components are in the folded orientation, without substantially inhibiting movement of the upper or lower ends between the closed and open positions.

28 Claims, 11 Drawing Sheets

PINCH-GRIP HANGER

CROSS-REFERENCE TO RELATED APPLICATIONS

This is a continuation-in-part of U.S. patent application Ser. No. 10/066,890, filed Feb. 4, 2002.

BACKGROUND OF THE INVENTION

The present invention relates to a pinch-grip hanger, and more particularly to a pinch-grip hanger adapted for use in transporting and displaying articles such as garments.

Pinch-grip hangers are well known. Pinch-grip hangers are frequently used in retail stores to display garments suspended from the pinch-grips, such as a pair of pants, a skirt, or the like. A hanger body includes an attachment portion for securing the hanger body to a support (for example, a hook for securing the hanger body to a transversely-extending elevated rod). A pinch-grip is attached to the hanger body. Optionally, the hanger body also includes a transverse portion defining a pair of free ends (for example, a pair of outwardly extending wings for supporting the shoulders of a jacket), and optionally one pinch-grip is disposed adjacent to each of the transverse portion free ends.

Each pinch-grip includes a pair of vertically-extending components, securing means (which may be part of the biasing means) for pivotably securing the components together, and means for biasing the bottom ends of the components together. Typically each component has an upper end, a lower end and a central or connecting component portion between the ends. The bottom ends are configured and dimensioned to cooperatively receive and maintain an article therebetween under the influence of the biasing means.

To insert or remove an article from the hanger, the upper ends of the components are pressed together so that the components pivot relatively and the lower ends thereof separate. In this "open" or releasing orientation, the article may be removed from or secured to the hanger. Finally, when the upper ends of the components are released, the biasing means causes the components to pivot relatively and return more-or-less to their original orientation with the upper ends spaced apart and the lower ends biased together. In this "closed" or gripping orientation, an article may be suspended by and between the component bottom ends. If no article is between them, the component bottom ends may actually touch and abut, thereby to form an "abutting" orientation.

However, such constructions have not proven to be entirely satisfactory from the point of view of the manufacturer, who must independently mold at least two separate and distinct plastic components and then transport them through the manufacturing process until they are secured together by the biasing or securing means. To overcome this manufacturing difficulty, various means have been suggested for providing connector means, separate and distinct from the securing means and biasing means, for pivotably connecting together the components prior to application of the biasing means thereto. Thus plastic connector means are integrally molded with the plastic components and pivotably secure the components together for movement between a substantially unfolded orientation, wherein the components lie in a common plane, and a substantially folded orientation, wherein the components are generally parallel). While this arrangement alleviates some of the aforementioned manufacturing difficulty, the resultant product has not proven to be entirely satisfactory in use.

Depending upon the particular design and placement of the connector means, the connector means may substantially inhibit movement of the upper or lower ends between the closed and open orientations, thereby defeating the very purpose of the pinch-grip. The connector means may project vertically or horizontally substantially beyond the components when the components are in the folded orientation. A projecting connector means is aesthetically disadvantageous because it is not substantially hidden from view (when the components are in the folded orientation) and, hence, is visible to the potential customer, and functionally disadvantageous because garments hung on the hanger (or, even garments hung on adjacent hangers) may become "caught" on such projections and possibly tear during the separation process.

Accordingly, it is an object of the present invention to provide a pinch-grip hanger including a connector means that does not substantially inhibit movement of the upper or lower ends of the components between the closed and open orientations.

Another object is to provide such a hanger wherein, in one preferred embodiment, the connector means does not project vertically or horizontally substantially beyond the components when the components are in the folded orientation.

A further object is to provide such a hanger wherein, in one preferred embodiment, the connector means is substantially hidden from view when the components are in the folded orientation.

It is another object of the present invention to provide such a hanger which is simple and inexpensive to manufacture, use and maintain.

BRIEF DESCRIPTION OF THE DRAWING

The above and related objects, features and advantages of the present invention will be more fully understood by reference to the following detailed description of the presently preferred, albeit illustrative, embodiments of the present invention when taken in conjunction with the accompanying drawing wherein.

SUMMARY OF THE INVENTION

Figure 1:
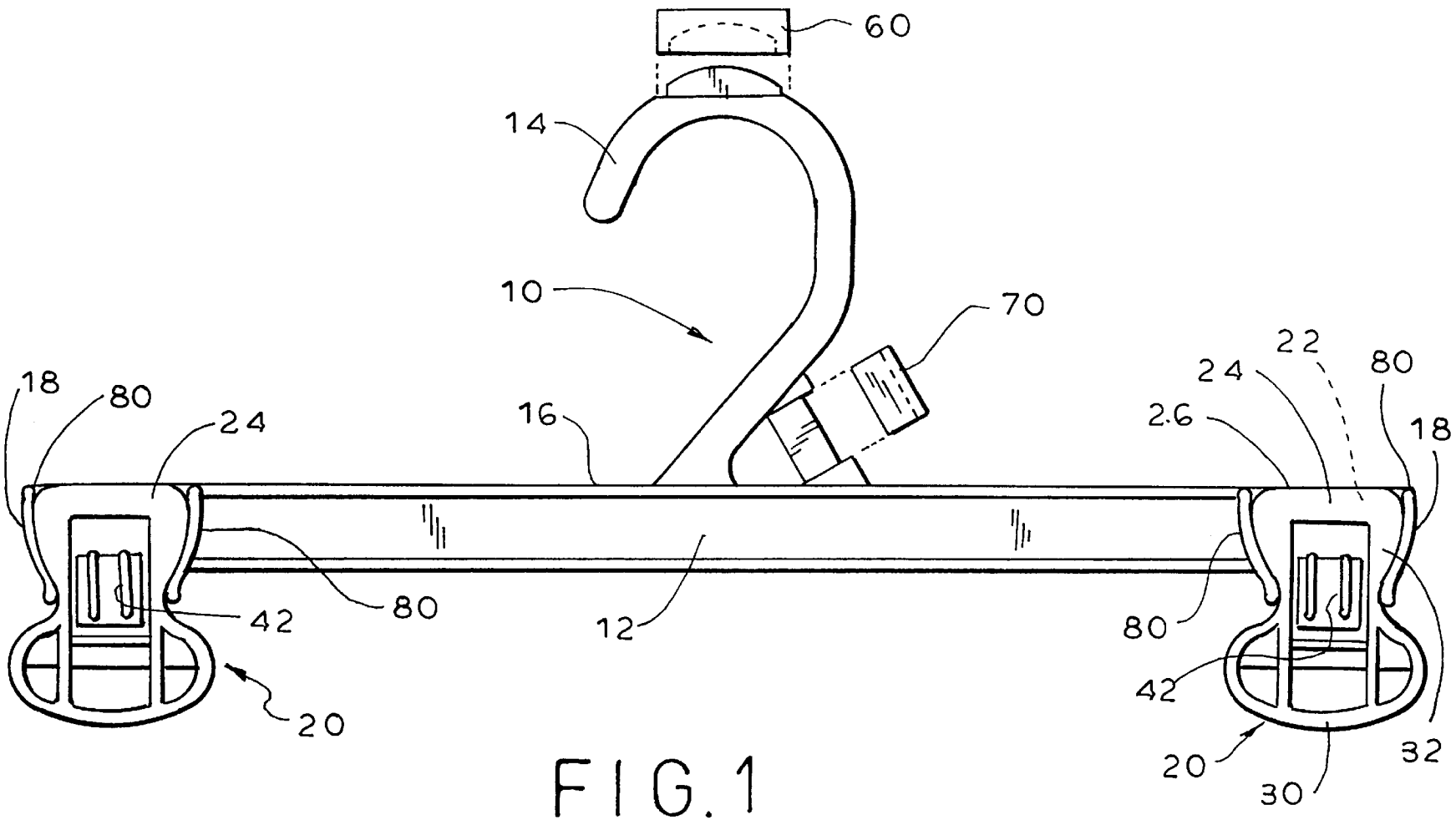
FIG. 1 is a front elevational view of a pinch-grip hanger according to the present invention with a top-sizer and side-sizer exploded therefrom.
Figure 2:
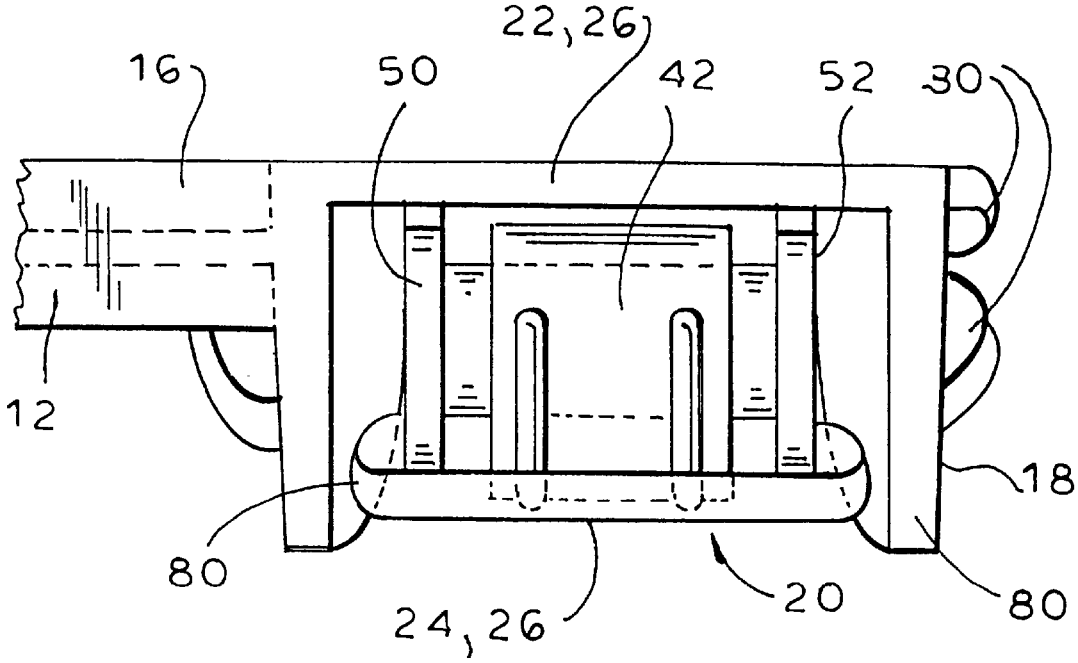
FIG. 2 is a fragmentary top plan view thereof.
Figure 3:
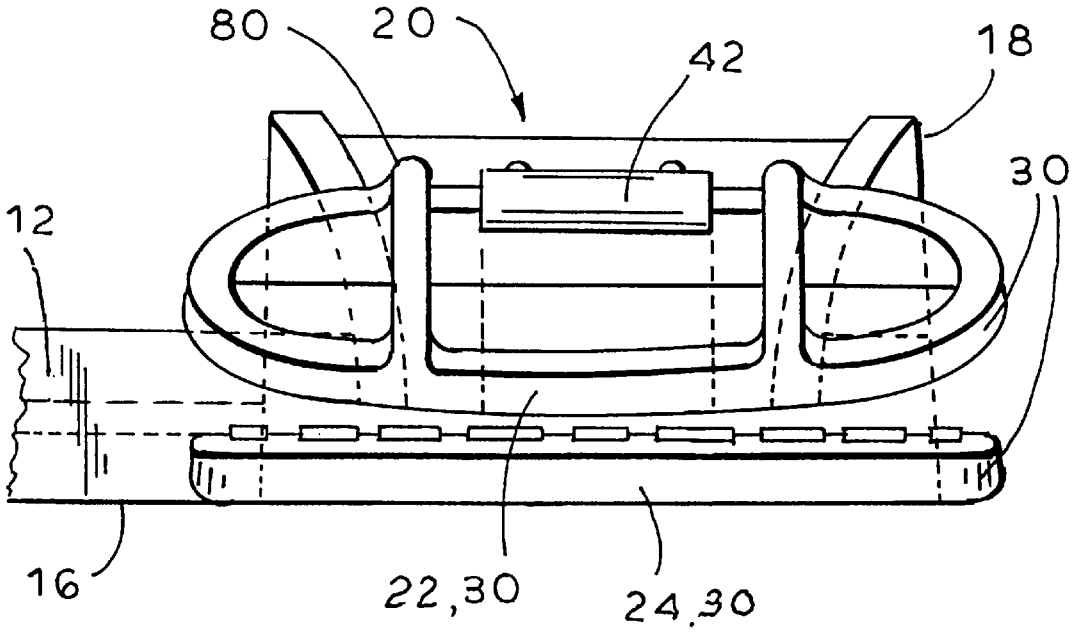
FIG. 3 is a fragmentary bottom plan view thereof.

It has now been found that the above and related objects of the present invention are obtained in a hanger comprising an attachment portion for securing the hanger to a support, and at least one pinch-grip for receiving an article for hanging. The pinch-grip includes (i) a pair of vertically-extending components, each of the components defining an upper end and a lower end, (ii) biasing means for biasing the lower ends together to a closed position and for permitting separation of the lower ends to an open position by movement of at least one of the upper ends relative to the other, and (iii) connector means for pivotably securing together the upper ends of the components for movement, prior to application of the biasing means to the components, between a substantially unfolded orientation, wherein the components lie in a common plane, and a substantially folded orientation, wherein the components are generally parallel. The connector means is flexible, integrally molded with the components and configured and dimensioned to lie between the upper ends of the components when the components are in the folded orientation.

In one embodiment, the connector means does not substantially inhibit movement of the upper or lower ends between the closed and open positions. The connector means is molded in a configuration such that, when the components are in the folded orientation, the connector means is generally concave, is disposed entirely above the biasing means, and connects only the tops of the upper ends of the components. The connector means does not project vertically or horizontally substantially beyond the components when the components are in the folded orientation, whereby the connector means is substantially hidden from view when the components are in the folded orientation.

Preferably the connector means comprises a pair of flexible connectors connecting the components, each of the flexible connectors being adjacent a respective lateral side of the components.

The pair of components typically defines a generally parallel pair of component-containing planes, and the connector may extend generally perpendicular to the component-containing planes so that opposed ends of the connector connect corresponding opposed points on the facing surfaces of the component upper ends. Alternatively, in a first preferred embodiment, the connector extends between the component upper ends at a substantially non-perpendicular angle to the component-containing planes. Where the connector comprises a pair of connector elements, each of the connector elements extends between the component upper ends, the connector elements being laterally offset and either parallel to one another or non-parallel.

In a second preferred embodiment, the connector has a pair of opposed ends, each of the opposed ends being connected to a respective component by a respective line of weakness, thereby to facilitate intentional removal of the connector from the components. The lines of weakness are preferably disposed above the component upper ends when the components are in the folded orientation so that the lines of weakness facilitate removal of the connector from the components when the components are in the folded orientation. Alternately, the lines of weakness are disposed below the tops of the component upper ends when the components are in the folded orientation.

The connector typically is separate and distinct from the biasing means and pivotably secures together the upper ends of the components for movement, prior to application of the biasing means to the components, between a substantially unfolded orientation and a substantially folded orientation. The connector may be of sufficient width and thickness to provide resiliency, thereby to supplement the biasing means. Alternately, in a third preferred embodiment, the connector and the biasing means are the same, the connector being formed of a resilient material possessing memory and biasing the component upper ends apart, the hanger being characterized by the absence of any biasing means except for the connector. In this embodiment, means, separate and distinct from the connector, are provided for pivotably securing together the components intermediate the component upper and lower ends, the components cooperatively defining a ball-and-socket joint intermediate the component upper and lower ends.

DETAILED DESCRIPTION OF THE PREFERRED EMBODIMENTS

Referring now to the drawing, and in particular to FIG. 1 thereof, therein illustrated is a secure pinch-grip hanger according to the present invention, generally designated by the reference numeral 10. In its conventional aspects, the hanger 10 comprises a hanger body 12 including an attachment portion 14 for securing the body 12 to a support (not shown) and optionally, as illustrated, a transverse portion 16 defining a pair of free outer ends 18. Although the attachment portion 14 is illustrated as a hook, clearly other means for attaching the hanger body 12 to a support (such as a transversely-extending elevated rod—not shown) may be utilized. The hanger body 12 (including both the attachment portion 14 and the optional transverse portion 16) is conveniently formed of injection molded plastic.

The hanger 10 additionally includes at least one pinch-grip, generally designated 20. Each pinch-grip 20 includes a pair of substantially rigid, vertically-extending components 22, 24. Each of the vertically-extending components 22, 24 defines an upper end 26, a lower end 30, and a body portion 32 between the ends 26, 30. Preferably, one pinch-grip 20 is disposed adjacent each free end 18 of the transverse portion 16 (as illustrated), although alternatively the hanger 10 may include a single pinch-grip 20 disposed centrally (i.e., intermediate the free ends 18).

Referring now to FIGS. 2–6 in particular, pivot means 40 is preferably provided for pivotably juxtaposing the components 22, 24 together such that, when the upper ends 26 of the components 22, 24 are brought together as close as possible, the lower ends 30 are separated from each other as far as possible (the "fully extended open position"). In use, when the upper ends 26 are moved toward the fully extended open position, the lower ends 30 thereof separate to enable insertion or removal of an article or garment therebetween ("the releasing orientation"). Preferably pivot means 40 pivotably juxtaposes a body portion 32 of one component 22, 24 to a body portion 32 of the other component 24, 22 when the components are in the folded orientation. The pivot means 40 optionally also secures together the two components 22, 24 (typically at the body portions 32) once the components 22, 24 are in the folded orientation. Preferably one component 24 is pivotable, and the other component 22 is stationary relative to the hanger body 12.

Biasing means 42 are provided for biasing the bottom ends 30 of the two components 22, 24 together to define the "closed" or gripping orientation wherein the upper ends 26 of the two components 22, 24 are spaced apart. In this orientation, the bottom ends 30 are configured and dimensioned to cooperatively receive and maintain an article, such as a garment G (shown in phantom line in FIG. 6) therebetween, thereby to suspend the garment on a rod or like support. In the absence of any garment between the bottom ends 30 of the two components 22, 24, biasing means 42 biases such bottom ends 30 together to define the "abutting" orientation wherein the bottom ends 30 touch. The biasing means 42 is commonly formed of resilient metal and is applied to the components 22, 24 after they are in the folded orientation.

The biasing means 42 is preferably separate and distinct from the pivot means 40, as illustrated; however the two means 40, 42 may be combined into a single element.

Turning now to the novel aspects of the present invention, flexible connector means 50 is separate and distinct from both the biasing means 42 and pivot means 40 and pivotably secures together the upper ends 26 of the components 22, 24, both prior to application of the biasing means 42 to the components 22, 24 (see FIGS. 7 and 8) and thereafter (see FIGS. 1–6). The connector means 50 is a living hinge that enables manual movement of the components 22, 24 between the substantially unfolded orientation, illustrated in FIGS. 7 and 8, wherein the components lie in a common plane (e.g., in the mold), and the substantially folded orientation, illustrated in FIGS. 1–6, wherein the components 22, 24 are generally parallel (e.g., in the pinch-grip). The connector means 50 is integrally molded with the components 22, 24 and configured and dimensioned to lie between the upper ends 26 thereof when the components 22, 24 are in the folded orientation. The connector means 50 connects only the tops of the upper ends 26 of the two components 22, 24 when the components 22, 24 are in the folded orientation, or only the adjacent tips of the components when they are in the unfolded orientation (e.g., in the mold).

Figure 9:
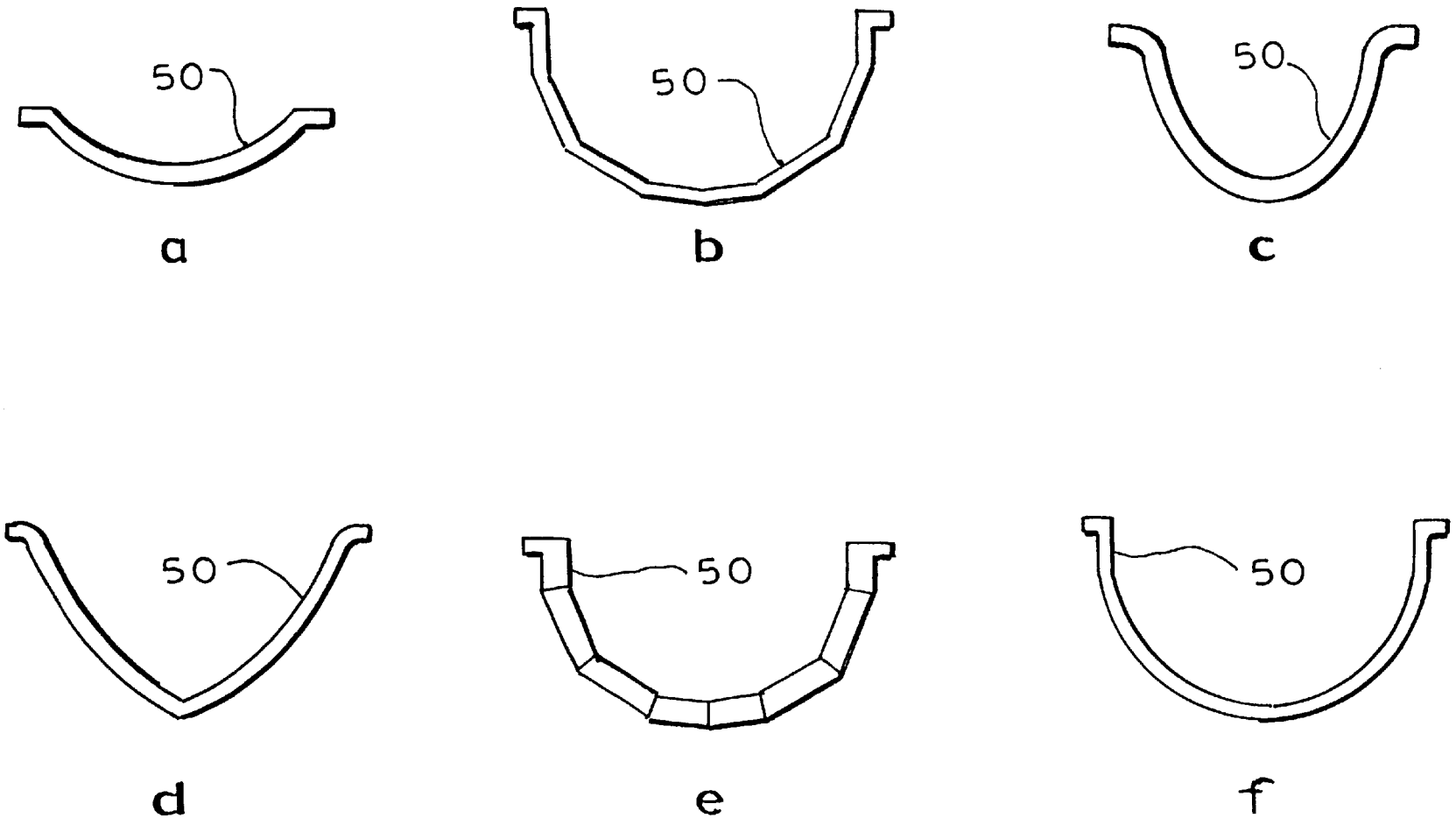
FIG. 9 is a side elevational view of six different configurations of the connector means of the pinch-grip.

Referring now to FIG. 9 in particular, the connector means 50 is molded in a configuration such that, when the components 22, 24 are in the folded orientation, the connector means 50 is generally concave. In the mold itself, the two components 22, 24 are generally disposed in a common plane with the connector means 50 convexly projecting upwardly from that common plane. Although it is also possible for the connector means 50 to concavely project downwardly into the mold (below the common plane), this is not the preferred molding technique. The concavity may extend all the way out to the ends of the connector means 50, as illustrated in views b, d, e and f of FIG. 9, or may stop short of the ends thereof, as illustrated in views a and c of FIG. 9. The concavity of the concave portion of the connector means 50 may be smooth, as illustrated in views a, c, and f, V-shaped, as illustrated in view d, or formed of a plurality of serially connected linear segments, as illustrated in views b and e. Where the concave portion of the connector means 50 does not include the very ends thereof, such ends may extend appreciably but insignificantly above the height of the upper ends 26 of the components 22, 24, when the components are in the folded orientation, but typically not sufficiently so as to be visually noticed or to serve as a catching point for any clothing on the hanger.

Figure 4:
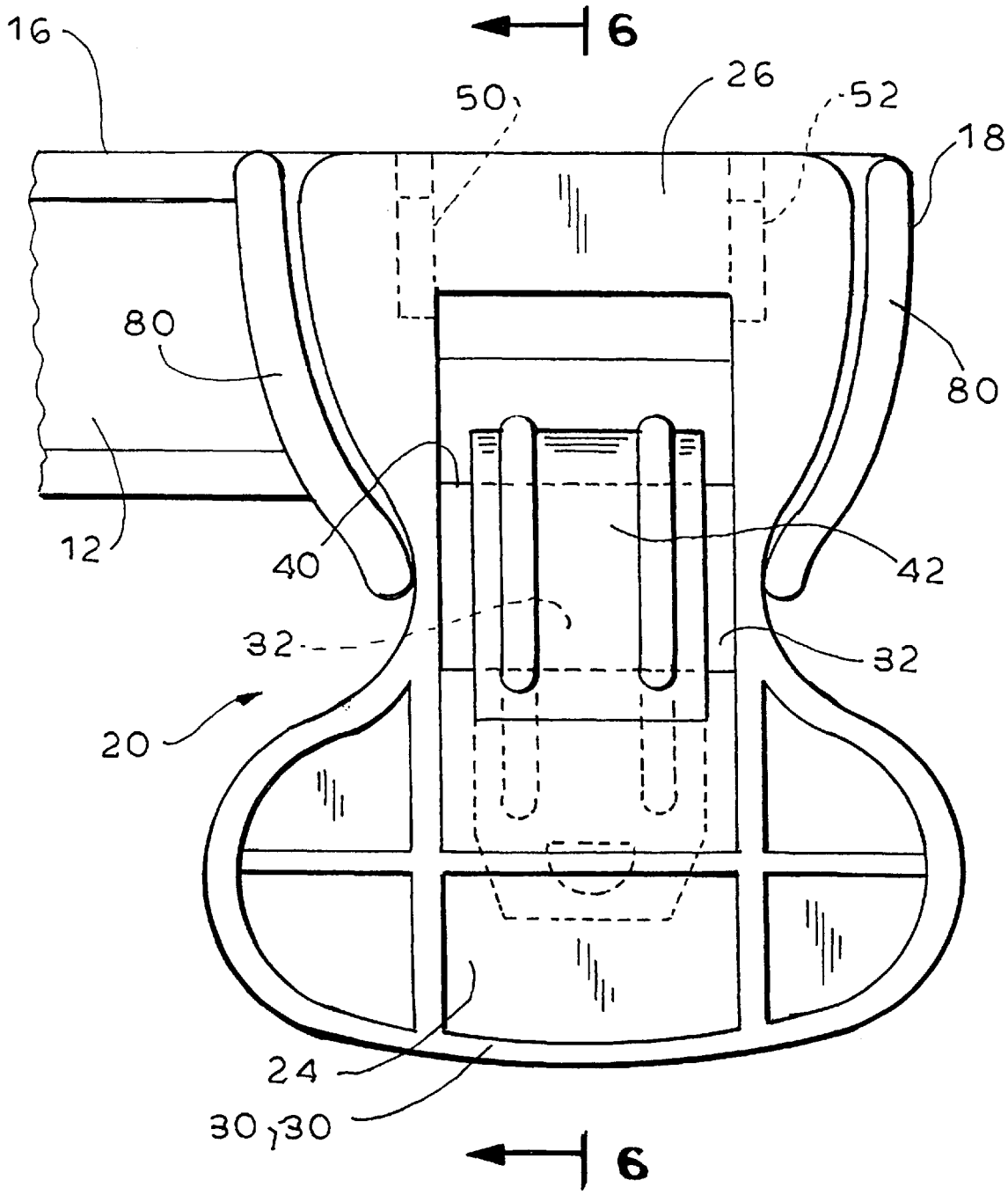
FIG. 4 is a fragmentary front elevational plan view thereof.
Figure 5:
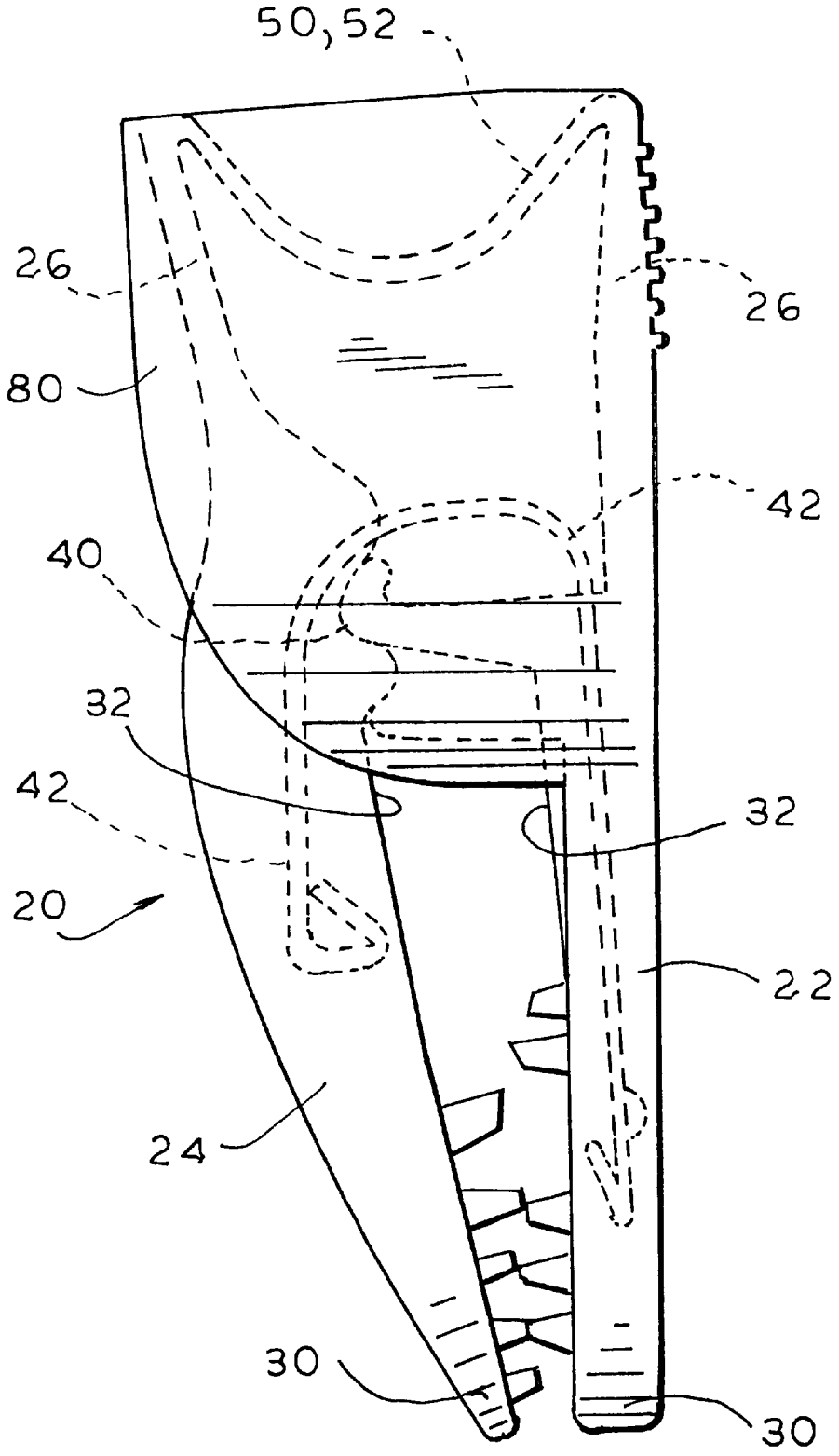
FIG. 5 is a fragmentary side elevational plan view thereof.
Figure 6:
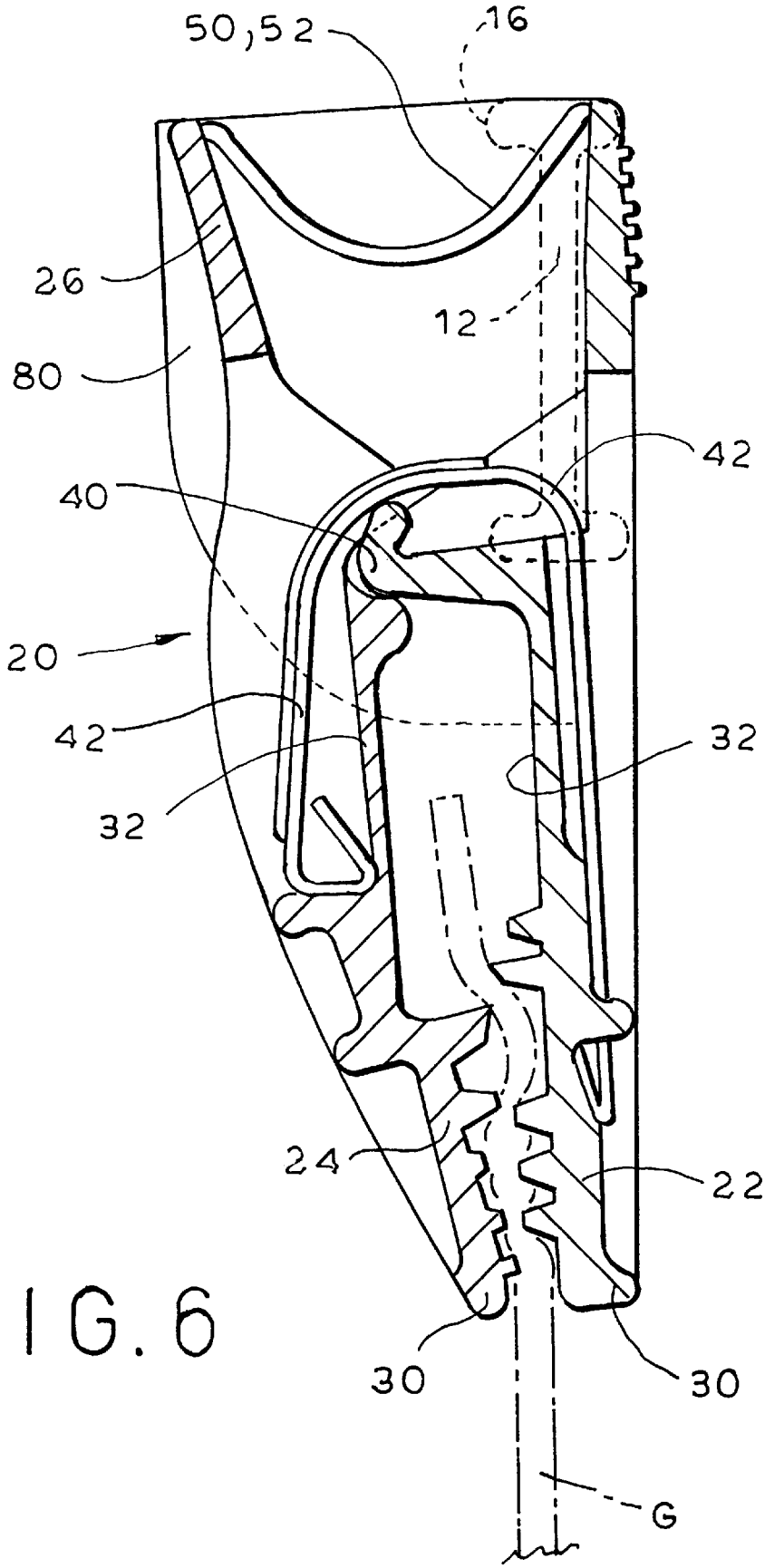
FIG. 6 is a fragmentary sectional plan view thereof taken along the lines 6—6 of FIG. 4.

Referring now to FIGS. 4–6 in particular, except perhaps for the very ends of the connector means 50 (where the connector means 50 connects with the upper ends 26 of the components 22, 24), the connector means 50 does not project vertically or horizontally substantially beyond the components 22, 24, when the components are in the folded orientation. Thus, in such a folded orientation, the connector means 50 are substantially hidden from view of the user and are not available for clothing to "catch" on.

Preferably the thickness of the connector means 50 is less than the thickness of the upper ends 26 of the components 22, 24 so that it can easily fold downwardly towards the biasing means 42 when the upper ends 26 of the components 22, 24 are pressed together (i.e., when the pinch-grip is placed in the open orientation). The length of the connector means 50 is preferably selected so that the bottom most portion thereof does not contact the biasing means 42, even when the pinch-grip is in the open orientation.

Referring again to FIG. 1 in particular, preferably the hanger according to the present invention is configured and dimensioned to releasably receive a top-sizer 60, as disclosed, for example, in Zuckerman, et al., U.S. Pat. No. 5,503,310 (hereby incorporated by reference), or a side-sizer 70, as disclosed, for example, in Zuckerman, et al., U.S. Pat. No. 6,145,713 (hereby incorporated by reference), for indicating size or other information of interest regarding the garment on the hanger. To enhance the security of the grip of the pinch-grip, protective projections 80 may be provided to inhibit accidental movement of the pinch-grip towards the open orientation while permitting intentional movement of the pinch-grip thereto, as disclosed in Zuckerman, et al., U.S. Pat. No. 6,021,933 (hereby incorporated by reference).

Figure 7:
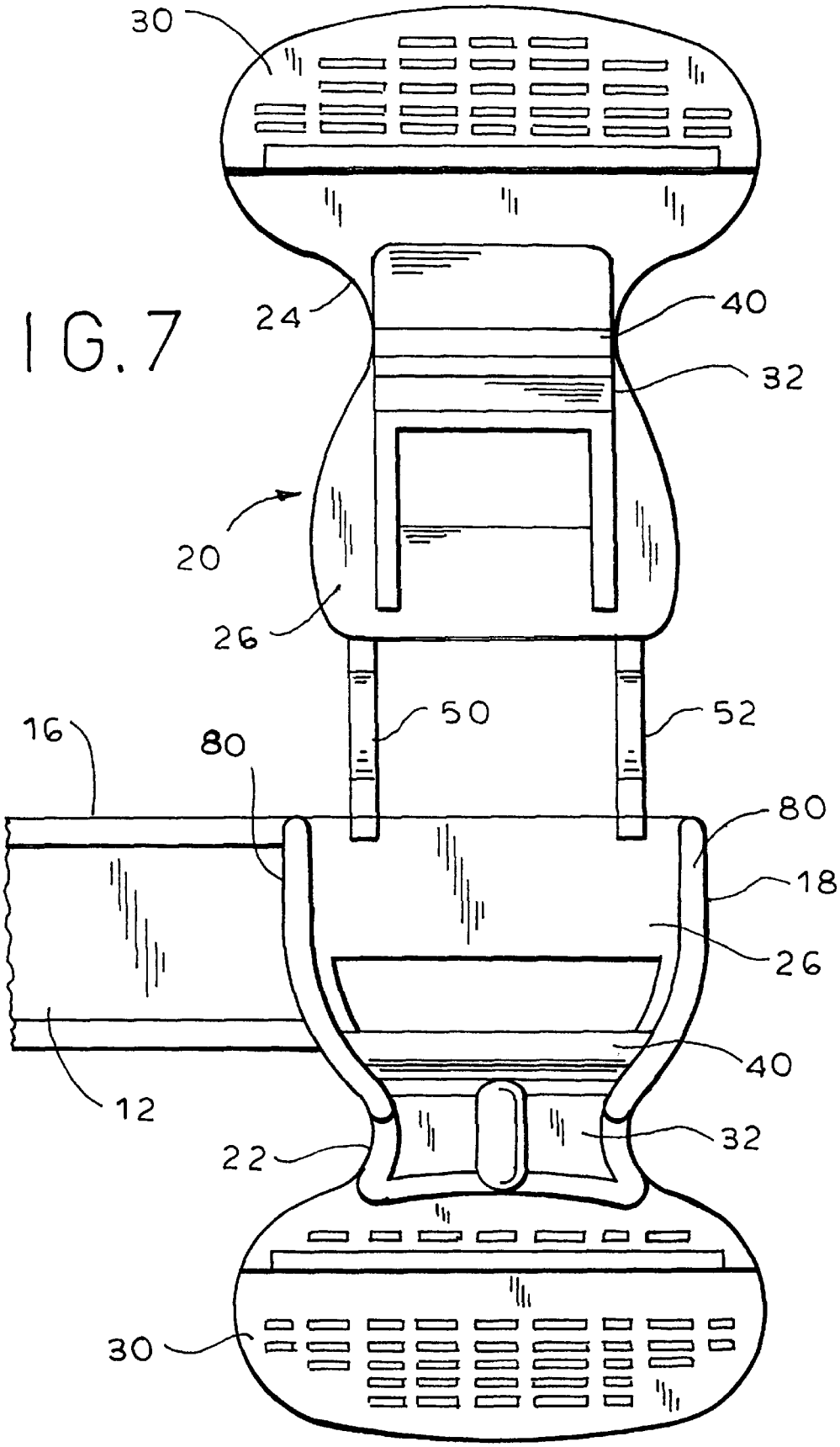
FIG. 7 is a fragmentary top plan view of the components in an extended, unfolded orientation prior to application of the biasing means.
Figure 8:
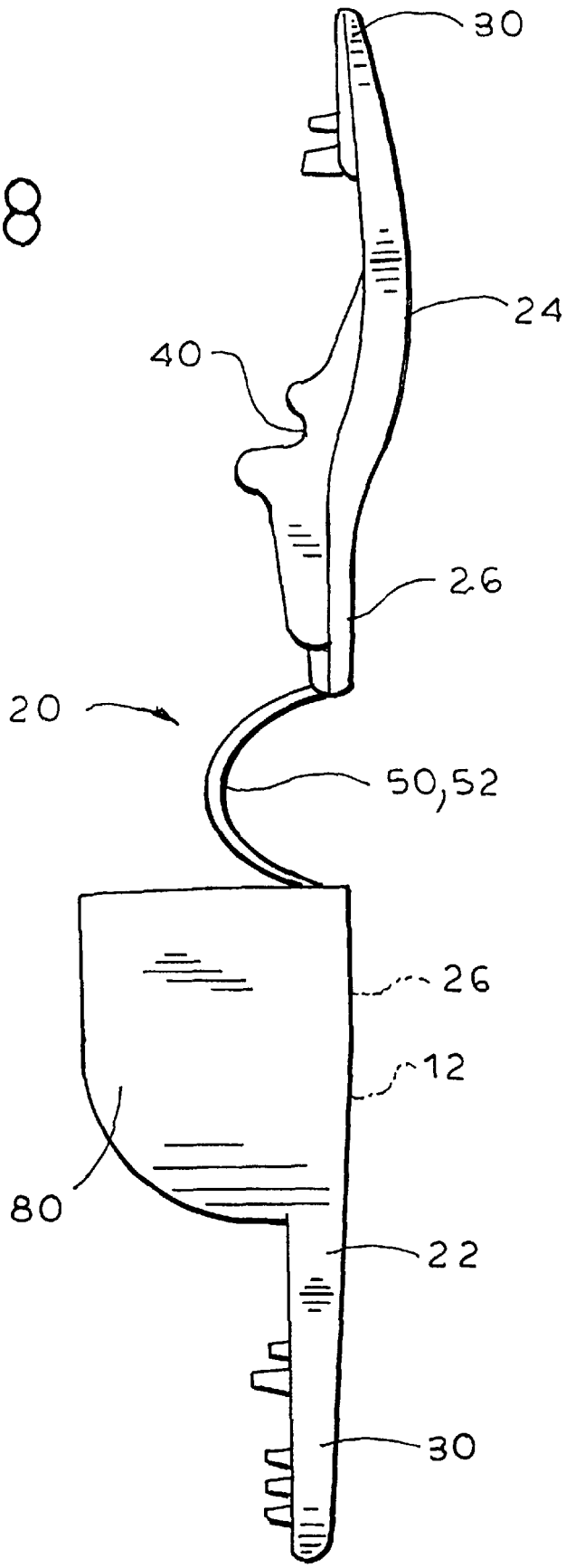
FIG. 8 is an end elevational view of the components of FIG. 7.

Referring now to FIGS. 4–8 in particular, the connector means 50 may comprise a pair of flexible connector elements 52. Each of the flexible connector elements 52 may be disposed adjacent a respective lateral side of the components 22, 24 to assist in stabilizing the relative spatial positions of the components 22, 24 in the unfolded orientation (as shown in FIG. 7) and in facilitating a balanced movement of the components 22, 24 from the unfolded orientation to the folded orientation (as shown in FIG. 8). As illustrated, the pair of components 22, 24 defines a generally parallel pair of component-containing planes, and the connector 50 extends perpendicular to such component-containing planes. Where the connector 50 defines a pair of connector elements 52, the opposed ends of the connector elements 52 connect corresponding opposed points on the facing surfaces of the component upper ends 26.

Figure 10A:
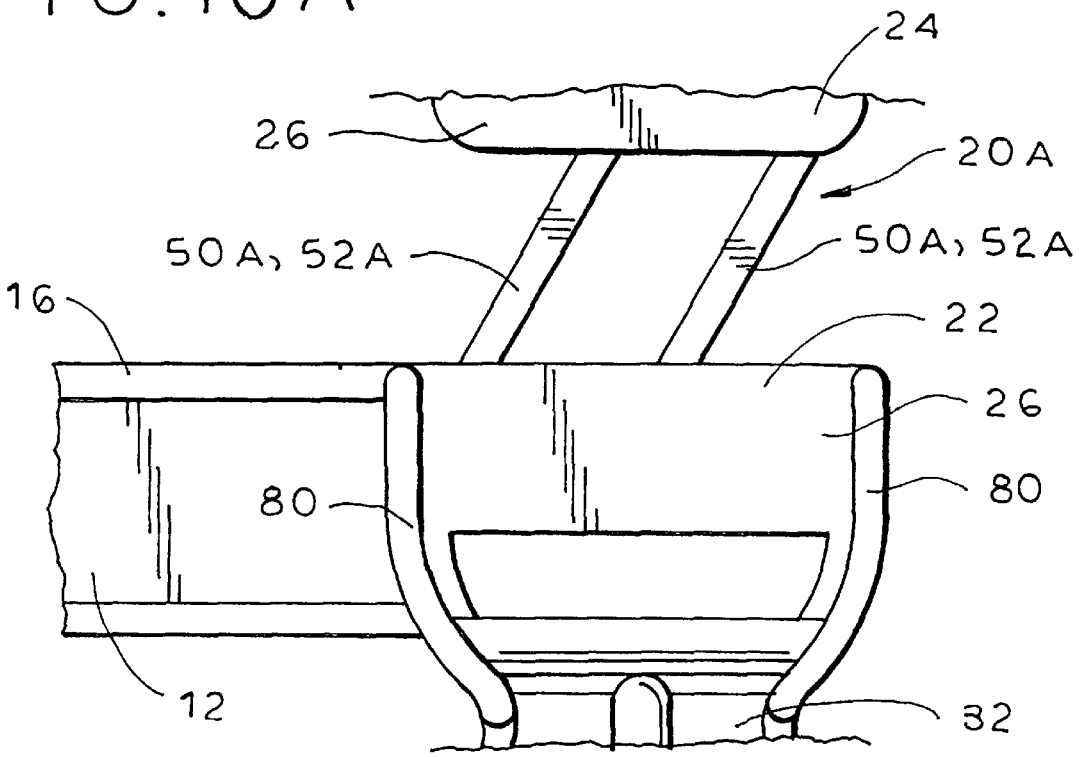
FIG. 10A is a fragmentary top plan view of a hanger with a pinch-grip having a pair of connector elements extending parallel to one another between the component upper ends at a substantially non-perpendicular angle to the component-containing planes.
Figure 10B:
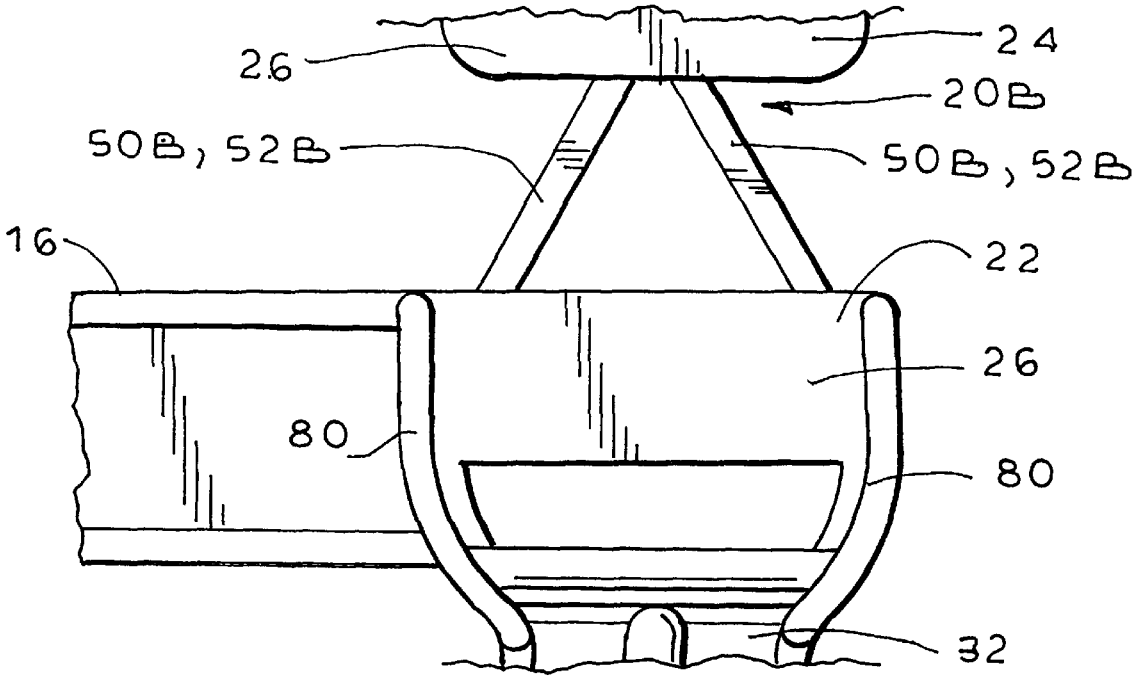
FIG. 10B is a fragmentary top plan view of a hanger with a pinch-grip having a pair of connector elements in a non-parallel relationship extending between the component upper ends at a substantially non-perpendicular angle to the component-containing planes.

Referring now to FIGS. 10A and 10B in particular, alternatively, in a first preferred embodiment of a pinch-grip, generally designated 20A or 20B, the connector 50A, 50B extends between the component upper ends 26 at a substantially non-perpendicular angle to the component-containing planes. As illustrated in FIG. 10A, the connector elements 52A of pinch-grip 20A are laterally offset and parallel to one another. One advantage of this arrangement is that the connector elements 52A may be longer than when they extend generally perpendicular to the component-containing planes, without increasing the separation between the upper ends 26 of the components 22, 24 either in the unfolded orientation or the folded orientation. The angled connector elements 52A additionally assist in maintaining the component upper ends 26 in appropriate juxtaposition and alignment. While the component elements 52A are illustrated in pinch-grip 20A as being angled from the right to the left, clearly the principles of the present invention would also apply if they were angled from the left to the right.

Alternatively, in the pinch-grip 20B, as illustrated in FIG. 10B, the connector 50B is comprised of a non-parallel pair of connector elements 52B. As illustrated, the component elements 52B diverge outwardly from a relatively close or touching disposition on the upper end 26 of component 24 to a relatively spaced apart disposition on the upper end 26 of component 22. As the connector elements 52B in combination with the one of the upper ends 26 define a generally triangular structure, one advantage of pinch-grip 20B is that the horizontal alignment of the upper ends 26 is even more strictly maintained due to the well-known rigidity of a triangular structure. Another advantage is that the separation between the upper ends 26 of the components is minimized when the pinch grip 20B is in its open position. Clearly the principles of the present invention would also apply if the connector elements 52B diverge outwardly from the upper end 26 of component 22 to the upper end 26 of component 24.

It will be appreciated by those skilled in the art that the primary function of the connector 50 is to maintain the two components 22, 24 as a unit through the production line, up to the point where the components 22, 24 are in the folded orientation and the biasing means 42 applied thereto. At this point, the connector 50 may be deemed superfluous.

Figure 11:
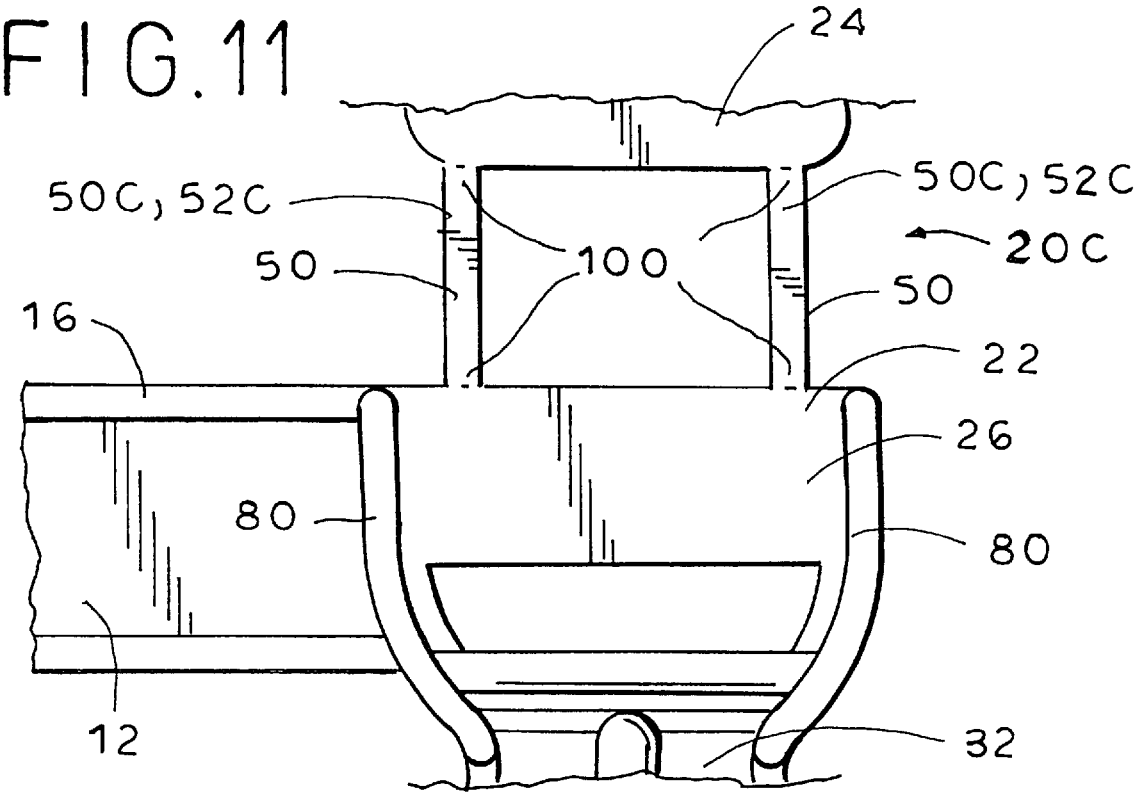
FIG. 11 is a fragmentary top plan view of a hanger with a pinch-grip having a pair of connector elements with the opposed ends thereof connected to a respective component by a respective line of weakness, thereby to facilitate intentional removal of the connector elements.

Referring now to FIG. 11, therein illustrated is a second preferred embodiment of the present invention using a pinch-grip generally designated 20C. In the pinch grip 20C, the connector 50C has a pair of opposed ends, each of the opposed ends being connected to a respective component 22, 24 by a respective line of weakness 100, thereby to facilitate intentional removal of the connector 50C from the components 22, 24 once the connector 50 is no longer necessary. As illustrated, the connector 50C is formed of a pair of connector elements 52C, each connector element 52C having a pair of opposed ends. Each connector element 52C has its opposed ends connected to a respective component 22, 24 by a respective line of weakness 100, thereby to facilitate intentional removal of the connector element 52C from the components 22, 24. A line of weakness, as used herein, refers to a plane where the connector 50C or connector element 52C is narrower, thinner, perforated or the like in order to define a preferred line of severance.

Preferably the lines of weakness 100 are disposed above the component upper ends 26 when the components 22, 24 are in the folded orientation so that the lines of weakness 100 facilitate removal of the connector elements 52C from the components 22, 24. Alternatively, however, the lines of weakness 100 may be disposed below the tops of the component upper ends 26 when the components 22, 24 are in the folded orientation, although this may present difficulties in the severance and removal of the component elements 52C and may leave unsightly upstanding stubs on the component upper ends 26, such stubs presenting snag possibilities. In the folded orientation the connector 52C may generally resemble a "U" or inverted "U."

In the previously described embodiments the connector 50 is separate and distinct from the biasing means 42 and pivotally secures the upper ends 26 of the components 22, 24 for movement, prior to application of the biasing means 42 to the components 22, 24, between the substantially unfolded orientation and the substantially folded orientation.

Figure 12B:
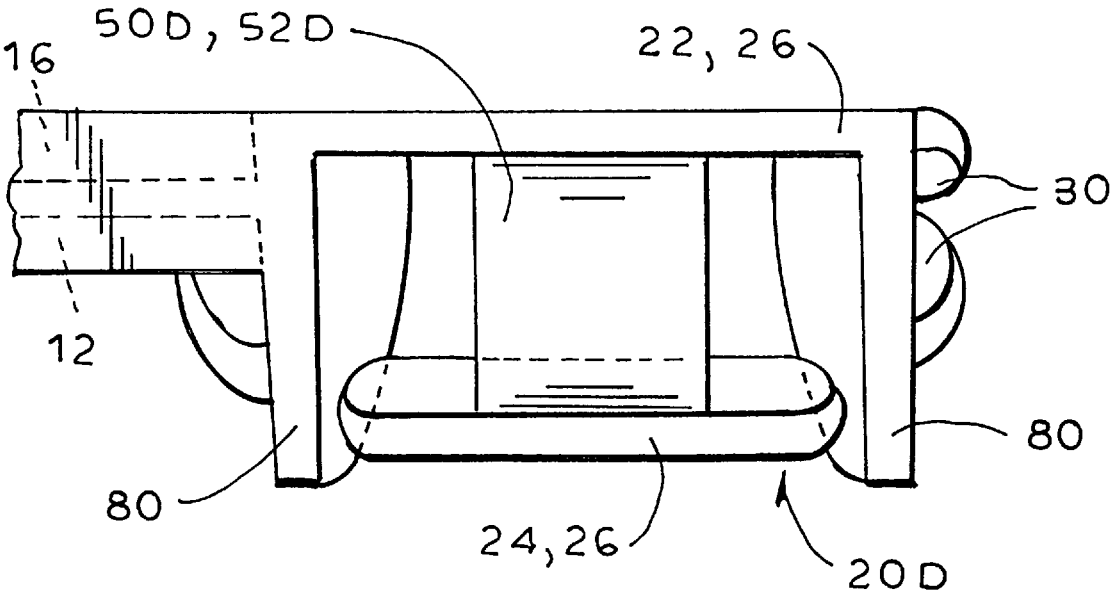
FIG. 12B is a fragmentary top plan view thereof in the folded orientation.
Figure 12A:
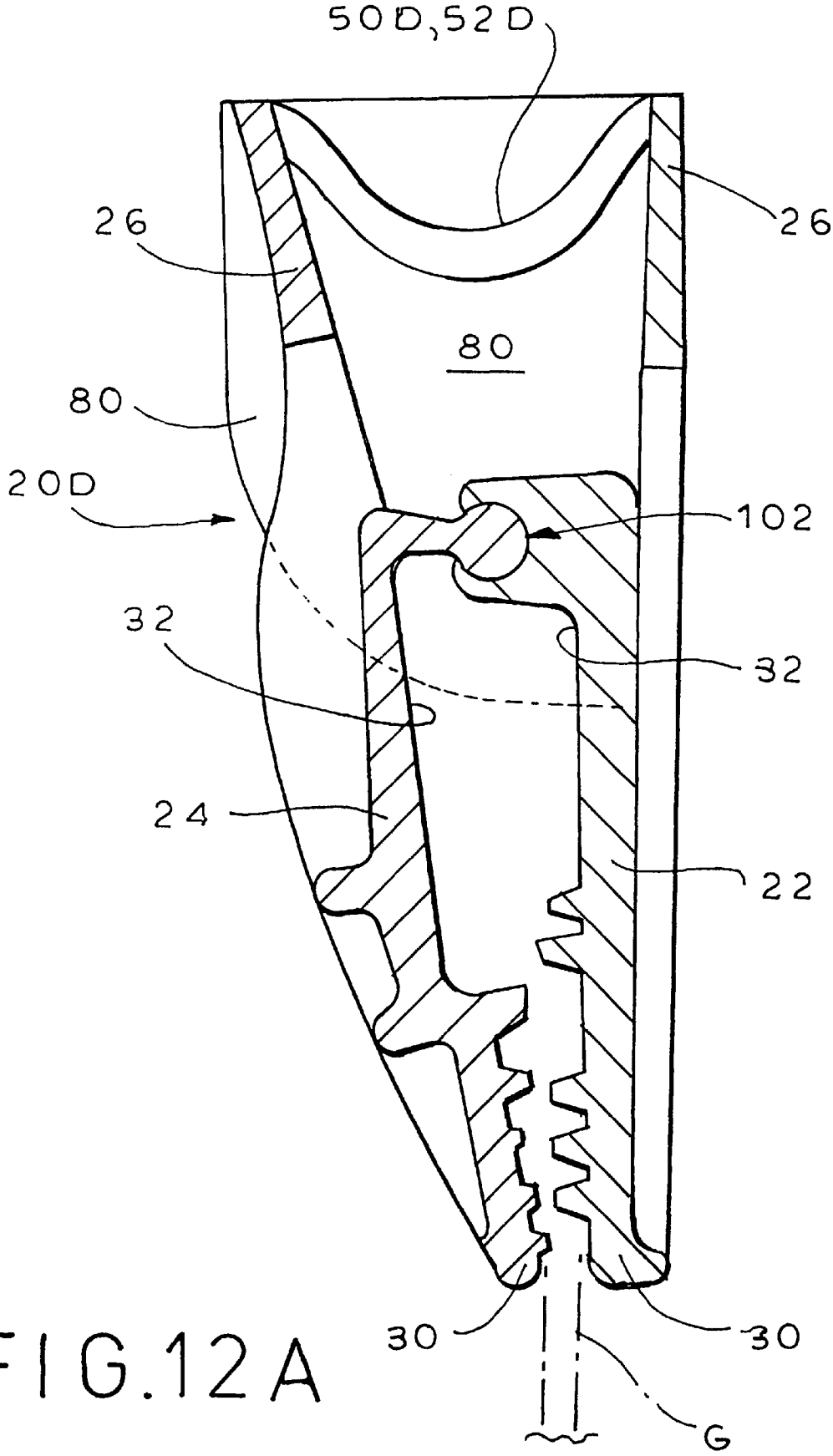
FIG. 12A is a fragmentary sectional view of a pinch grip wherein the connector and the biasing means are the same, characterized by the absence of any biasing means except for the connector.

On the other hand, in a third preferred embodiment of the present invention using a pinch-grip generally designated 20D, the utility of the connector 50D does not terminate with the manufacture and assembly of the pinch-grip 20D. Referring now to FIGS. 12A and 12B in particular, therein illustrated is a pinch-grip 20D wherein the connector 50D is of sufficient width and thickness to provide resiliency. In this embodiment the connector 50D and the biasing means are the same, because the connector 50D also acts as the biasing means, and the hanger is characterized by the absence of any biasing means except for the connector. The connector 50D is formed of resilient material possessing memory and biases the component upper ends 26 apart, thereby achieving the same effect as the biasing means of the other embodiments. As illustrated in FIG. 12B, the connector 50D is comprised of a single connector element 50D rather than a pair of connector elements; however, the principles of the present invention apply equally where there are a plurality of connector elements which in combination provide the function of the single connector element 50D.

As the third preferred embodiment 20D does not use a separate biasing means to maintain the components 22, 24 in the folded orientation, means, generally designated 102, are provided for pivotally securing together the components 22, 24 intermediate the component upper and lower ends 26, 30. More particularly, the means 102, which is separate and distinct from the connector 50D, is defined by the components 22, 24 themselves. Thus, preferably the components 22, 24 cooperatively define a ball-and-socket joint 102 intermediate the component upper and lower ends 26, 30. More, particularly, the joint 102 maintains the components 22, 24 in a pivotable relationship, while they are in the folded orientation, so that the connector 50D can exert outward pressure on the upper end of the movable component 24, thereby causing the bottom end 30 of the connector 24 to approach the bottom end of stationary component 22, thereby to maintain a garment G therebetween.

In a variant of the third preferred embodiment pinch-grip 20D, also seen in FIG. 12B, a connector 50D affording a high level of resiliency and memory may be used to supplement the conventional biasing means 42 of FIGS. 1–6 without replacing the same. This enables the use of a weaker, but less expensive, biasing means 42 than would be the case if the force exerted by the biasing means 42 were not to be supplemented by the connector 50D.

Thus, in the first preferred embodiment the connector elements 52A, 52B assist in stabilization of the opposing alignment of the component upper ends 26, in the second preferred embodiment the connectors elements 52C are removable after manufacture and assembly, and in the third preferred embodiment the connector 50D supplements or replaces the biasing means 42 after manufacture and assembly.

To summarize, the present invention provides a pinch-grip hanger including a connector means that does not substantially inhibit movement of the upper or lower ends of the components between the closed and open orientations. Further, the connecting means does not project vertically or horizontally beyond the components when the components are in the folded orientation, so that the connecting means is substantially hidden from view when the components are in the folded orientation. The hanger is simple and inexpensive to manufacture, use and maintain.

Now that the preferred embodiments of the present invention have been shown and described in detail, various modifications and improvements thereon will become readily apparent to those skilled in the art. Accordingly, the spirit and scope of the present invention is to be construed broadly and limited only by the appended claims, and not by the foregoing specification.

We claim:

1. A hanger comprising:

(A) an attachment portion for securing said hanger to a support; and (B) at least one pinch-grip for receiving an article for hanging, said pinch-grip including:

(i) a pair of vertically extending components, each component defining an upper end and a lower end;

(ii) biasing means for biasing the lower ends together to a closed position and for permitting separation of the lower ends to an open position by movement of at least one of the upper ends towards the other; and (iii) a connector for pivotably securing together the upper ends of the components for movement between a substantially unfolded orientation and a substantially folded orientation;

the connector being flexible, integrally molded with the components, and configured and dimensioned to extend between the upper ends of the components when the components are in the folded orientation.

2. The hanger of claim 1 wherein said connector does not substantially inhibit movement of said lower ends between said closed and open positions.

3. The hanger of claim 1 wherein said connector does not project vertically or horizontally substantially beyond said components when said components are in said folded orientation.

4. The hanger of claim 3 wherein said connector lies substantially between said component upper ends and is substantially hidden from view when said components are in said folded orientation.

5. The hanger of claim 1 wherein said connector is molded in a configuration such that, when said components are in said folded orientation, said connector is generally concave.

6. The hanger of claim 1 wherein said connector connects only the tops of said upper ends of said components.

7. The hanger of claim 1 wherein said connector is disposed entirely above said biasing means.

8. The hanger of claim 1 wherein said connector comprises a pair of connector elements, each of said connector elements being adjacent a respective lateral side of said components.

9. The hanger of claim 1 wherein said pair of components defines a generally parallel pair of component-containing planes, and said connector extends generally perpendicular to said component-containing planes.

10. The hanger of claim 1 wherein opposed ends of said connector connect corresponding opposed points on the facing surfaces of said component upper ends.

11. A hanger comprising:

(A) an attachment portion for securing said hanger to a support; and (B) at least one pinch-grip for receiving an article for hanging, said pinch-grip including:

(i) a pair of vertically extending components, each component defining an upper end and a lower end;

(ii) biasing means for biasing the lower ends together to a closed position and for permitting separation of the lower ends to an open position by movement of at least one of the upper ends relative to the other; and (iii) a connector for pivotably securing together the upper ends of the components for movement between a substantially unfolded orientation and a substantially folded orientation;

the connector being flexible, integrally molded with the components, and configured and dimensioned to extend between the upper ends of the components when the components are in the folded orientation;

the pair of components defining two generally parallel component-containing planes, and the connector extending between the component upper ends at a substantially non-perpendicular angle to the component-containing planes.

12. The hanger of claim 11 wherein said connector comprises a pair of connector elements, each of said connector elements extending between said component upper ends.

13. The hanger of claim 12 wherein said connector elements are laterally offset and parallel.

14. The hanger of claim 12 wherein said connector elements are non-parallel.

15. A hanger comprising:

(A) an attachment portion for securing said hanger to a support; and (B) at least one pinch-grip for receiving an article for hanging, said pinch-grip including:

(i) a pair of vertically extending components, each component defining an upper end and a lower end;

(ii) biasing means for biasing the lower ends together to a closed position and for permitting separation of the lower ends to an open position by movement of at least one of the upper ends relative to the other; and (iii) a connector for pivotably securing together the upper ends of the components for movement between a substantially unfolded orientation and a substantially folded orientation;

the connector being flexible, integrally molded with the components, and configured and dimensioned to extend between the upper ends of the components when the components are in the folded orientation;

the connector having a pair of opposed ends, each of the opposed ends being connected to a respective component by a respective line of weakness, thereby to facilitate intentional removal of the connector from the components.

16. The hanger of claim 15 wherein said lines of weakness are disposed above said component upper ends when said components are in said folded orientation.

17. The hanger of claims 15 wherein said lines of weakness are disposed below the tops of said component upper ends when said components are in said folded orientation.

18. The hanger of claim 16 wherein said lines of weakness facilitate removal of said connector from said components when said components are in said folded orientation.

19. The hanger of claim 1 wherein said connector is separate and distinct from said biasing means and pivotably secures together said upper ends of said components for movement, prior to application of said biasing means to said components, between a substantially unfolded orientation and a substantially folded orientation.

20. A hanger comprising:

(A) an attachment portion for securing said hanger to a support; and (B) at least one pinch-grip for receiving an article for hanging, said pinch-grip including:

(i) a pair of vertically extending components, each component defining an upper end and a lower end;

(ii) biasing means for biasing the lower ends together to a closed position and for permitting separation of the lower ends to an open position by movement of at least one of the upper ends relative to the other; and (iii) a connector for pivotably securing together the upper ends of the components for movement between a substantially unfolded orientation and a substantially folded orientation;

the connector being flexible, integrally molded with the components, and configured and dimensioned to extend between the upper ends of the components when the components are in the folded orientation;

the connector being separate and distinct from the biasing means and pivotably securing together the upper ends of the components for movement, prior to application of the biasing means to the components, between a substantially unfolded orientation and a substantially folded orientation;

the connector possessing memory and being of sufficient width and thickness to provide appreciable resiliency.

21. The hanger of claim 1 wherein said connector and said biasing means are the same, said connector being formed of a resilient material possessing memory and biasing said component upper ends apart.

22. The hanger of claim 21 characterized by the absence of any biasing means except for said connector.

23. The hanger of claim 21 additionally including means, separate and distinct from said connector, for pivotably securing together said components intermediate said component upper and lower ends.

24. The hanger of claim 23 wherein said components cooperatively define a ball-and-socket joint intermediate said component upper and lower ends.

25. A hanger comprising:

(A) an attachment portion for securing the hanger to a support; and (B) at least one pinch-grip for receiving an article for hanging, the pinch-grip including:

(i) a pair of vertically extending components, each component defining an upper end and a lower end, the pair of components defining a generally parallel pair of component-containing planes;

(ii) biasing means for biasing the lower ends together to a closed position and for permitting separation of the lower ends to an open position by movement of at least one of the upper ends relative to the other; and (iii) a connector having a pair of opposed ends for pivotably securing together the upper ends of the components for movement between a substantially unfolded orientation and a substantially folded orientation;

the connector being flexible, integrally molded with the components, and configured and dimensioned to extend between the upper ends of the components when the components are in the folded orientation;

the connector being characterized by at least one of the following:

(a) the connector extending between the component upper ends at a substantially non-perpendicular angle to the component-containing planes;

(b) each of the opposed connector ends being connected to a respective component by a respective line of weakness, thereby to facilitate intentional removal of the connector from the components; and (c) the connector and the biasing means being the same, and the connector being formed of a resilient material possessing memory and biasing the component upper ends apart.

26. The hanger of claim 1 wherein the vertical position of the biasing means in the hanger is fixed and not manually variable to effect the movement of one of the upper ends relative to the other.

27. The hanger of claim 1 wherein the closed position is characterized by the upper ends being spaced apart by a first distance, and the open position is characterized by the upper ends being spaced apart by a second distance, said first distance being substantially greater than the second distance.

28. The hanger of claim 1 wherein the connector lies between the upper ends of the components when the components are in the folded orientation.

* * * * *